US007033004B2

(12) United States Patent
Ghisalberti et al.

(10) Patent No.: US 7,033,004 B2
(45) Date of Patent: Apr. 25, 2006

(54) DEVICE FOR FEEDING PREPACKAGED INK TO THE INK DUCT OF PRINTING MACHINES

(75) Inventors: Lorenzo Ghisalberti, Stezzano (Bergamo) (IT); Marcello Ghisalberti, Pedrengo (Bergamo) (IT)

(73) Assignee: T.G.C. S.R.L., Grassobbio (IT)

( * ) Notice: Subject to any disclaimer, the term of this patent is extended or adjusted under 35 U.S.C. 154(b) by 191 days.

(21) Appl. No.: 10/685,578

(22) Filed: Oct. 16, 2003

(65) Prior Publication Data

US 2004/0089174 A1 May 13, 2004

(30) Foreign Application Priority Data

Nov. 7, 2002 (IT) ..... MI2002A2364

(51) Int. Cl.
*B41J 2/175* (2006.01)

(52) U.S. Cl. ..... 347/85

(58) Field of Classification Search ..... 347/7, 347/49, 85; 101/335; 222/94, 95, 105, 160, 222/167, 250, 373
See application file for complete search history.

(56) References Cited

U.S. PATENT DOCUMENTS 3,720,473 A * 3/1973 Nakata ..... 401/40
5,060,826 A * 10/1991 Coleman ..... 222/95
5,150,820 A * 9/1992 McGill ..... 222/95
5,505,336 A * 4/1996 Montgomery et al. ..... 222/82
5,620,115 A * 4/1997 McGill ..... 222/95
5,799,578 A * 9/1998 Junghans ..... 101/348
5,918,767 A * 7/1999 McGill ..... 222/95
6,067,906 A * 5/2000 Ryan et al. ..... 101/335
6,085,652 A 7/2000 Deschner et al.
6,619,206 B1 * 9/2003 Koehler ..... 101/364
6,874,872 B1 * 4/2005 Lewis et al. ..... 347/85

FOREIGN PATENT DOCUMENTS

DE 3714160 11/1987
DE 19953324 5/2001
WO WO 00/10810 3/2000

* cited by examiner

*Primary Examiner*—Anh T. N. Vo
(74) *Attorney, Agent, or Firm*—Young & Thompson

(57) ABSTRACT

A device for feeding ink prepackaged in containers to the ink duct of printing machines includes a unit for holding the container and for dispensing the ink contained therein, where the unit included a base provided with at least one through aperture, an intermediate component and an operating head, in which the base, the intermediate component and optionally the operating head define, when in their operative position, a compartment for receiving the container, and in which the operating head includes a press operated by pressurized fluid to exert a pressure on the container ink to dispense it.

25 Claims, 9 Drawing Sheets

302
303a
36
304
51
64
63
50
65
67
302b
303b
323
66
68
52
304b
R
C 202
203a
36
61
62
204
51
227
50
U
202b
60
203b
223
52
204b
R
C 127
57
53
56
54
58
55
59

102
47
45
48
103a
36
49
104
128
121
129
51
U
143
127
50
102b
46
103b
122
123
126
52
104b
R
C

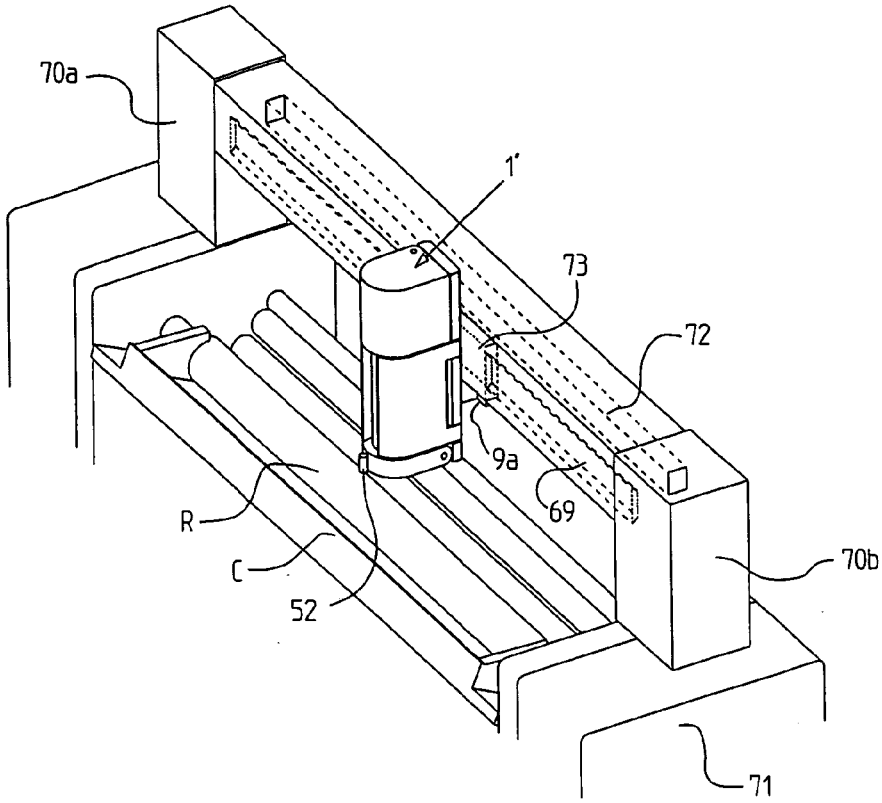
fig.3
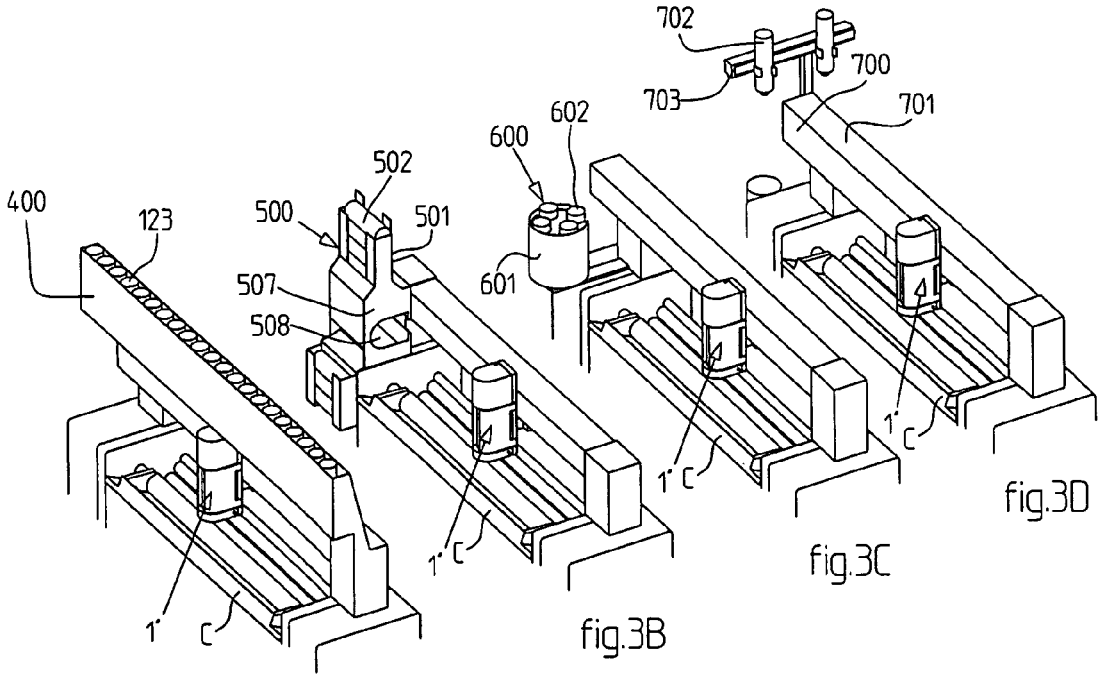
fig.3A
fig.3B
fig.3C
fig.3D fig.6c1 fig.6b1

DEVICE FOR FEEDING PREPACKAGED INK TO THE INK DUCT OF PRINTING MACHINES

The present invention relates to a device for directly feeding ink prepackaged in containers to the ink duct of printing machines. Printing machines are provided with ink ducts containing the ink to be accurately dispensed to the rollers and rotary cylinders which by their combined action ink the printing matrix. During their operation the ink ducts have to be constantly filled with ink to prevent the printing being compromised or impeded by deficiency or lack of ink.

Progressing from manual filling of the ink ducts, done by manually withdrawing the ink from cans by means of a spatula, the most advanced methodologies involve automatic feeding directly from large-dimension containers or drums (vessels). The drums are positioned outside the printing machine and feed the ink to the ink duct via a complex system comprising pumps, valves and pipes. As a printing machine is provided with several ink ducts and can at any given time use inks of various colours, an ink feed pipe must reach each ink duct from all the drums (vessels). Such complex systems can evidently be used only in printing machines of large format and/or high print run, which consume ink in significant quantities and preferably in a limited variety of colours, for example four colours.

A minimum consumption of many inks not only does not justify the large-quantity purchase of these inks, but also prejudices the operability of the feed systems, which are unable to provide all the inks usable for printing unless the drums (vessels) in use are replaced after previous cleaning of the connection pipes to the ink ducts. Adding to this the fact that such systems, even though provided with ink level control in the ink duct, feed the ink in large quantity and with evident wastage at the end of the print run as the ink, which tends to oxidize, cannot be left a long time in the ink duct and, in any event, if the subsequent work requires another ink, the residual quantity of the ink in use must necessarily be removed.

A second category regards those feed systems using a cartridge containing a small or modest ink quantity, the ink being expelled from the cartridge by pressing the cartridge. Although these systems offer greater constructional simplicity and flexibility of use (such that they can also be applied on machines of medium-small format and/or low print run) they present the drawback of requiring a specific type of cartridge which once empty has to be replaced, and a specific construction of the means which exert the pressing action on the cartridge.

An object of the present invention is to provide means and devices which combine the simplicity and flexibility of cartridge feed with the reliability and independence of automatic systems for feeding from a drum (vessel). Another object of the invention is to provide means which enable the ink to be distributed along the length of the ink duct.

A further object of the present invention is to provide means which enable an ink container to be automatically loaded/discharged.

These and further objects and advantages are attained by the device of the invention, the characteristics of which are highlighted in the accompanying claims.

The invention will be more apparent from the detailed description of preferred embodiments thereof given hereinafter by way of non-limiting example and illustrated in the accompanying drawings, in which:

FIG. 1 is a perspective view of a unit for holding the container and for dispensing the ink from said container, said unit constituting the core of a first version of the device of the invention;

FIG. 1*a* is a horizontal section through a detail relative to the means for rotating the unit of FIG. 1 about a horizontal axis and to the means for controlling the jaw elements;

FIG. 1*b* shows schematically the means for vertically sliding the head and base and the means for rotating said base of the unit of FIG. 1;

FIG. 1*c* is a schematic view from above showing the means for rotating the head of the device of FIG. 1;

FIG. 1*d* is a schematic longitudinal section through the ink expulsion means;

FIGS. 2A, B, C are a schematic longitudinal section through the unit of FIG. 1 suitable for operating on different containers;

FIG. 3 is a schematic perspective view of a version of the device in which the ink container-holding and dispensing unit can translate above an ink duct;

Figure 1:
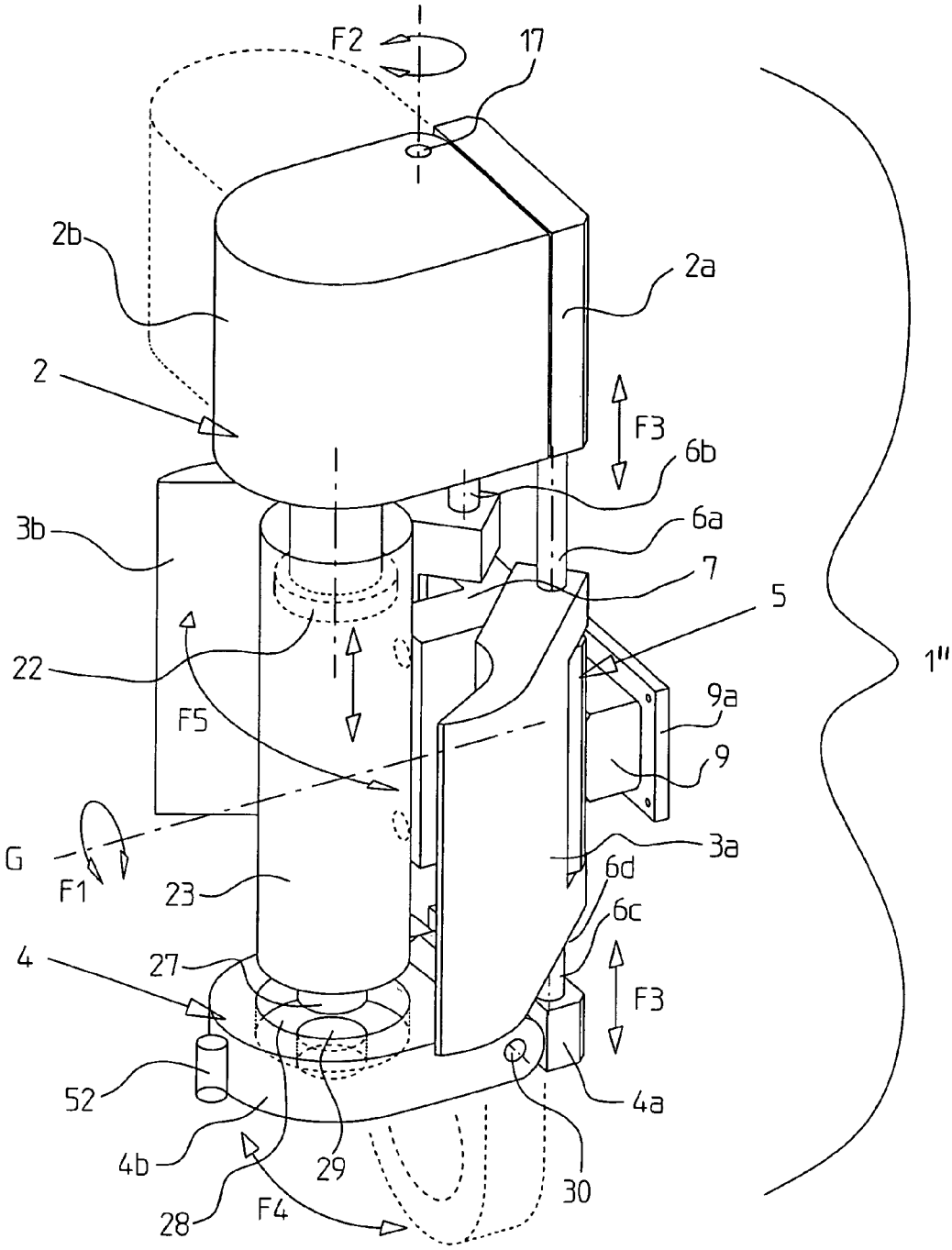
Figure 4C:
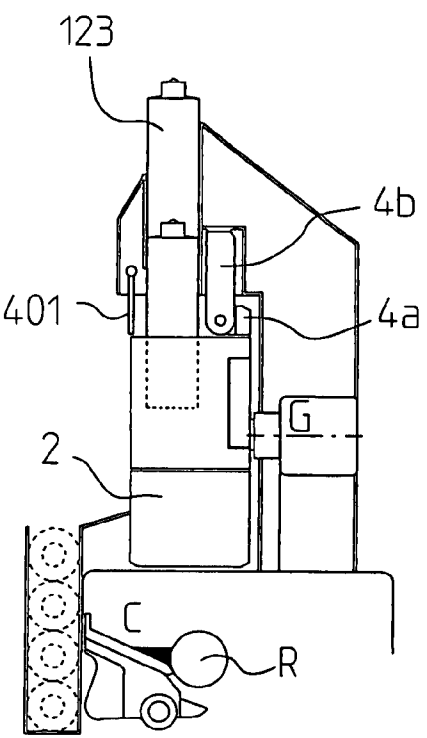
Figure 4B:
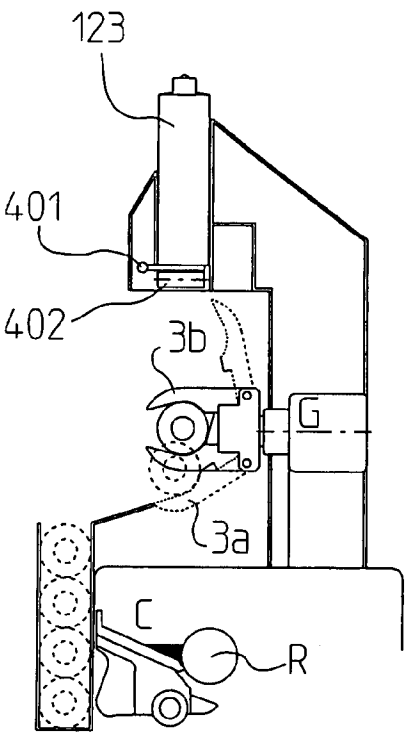
Figure 4A:
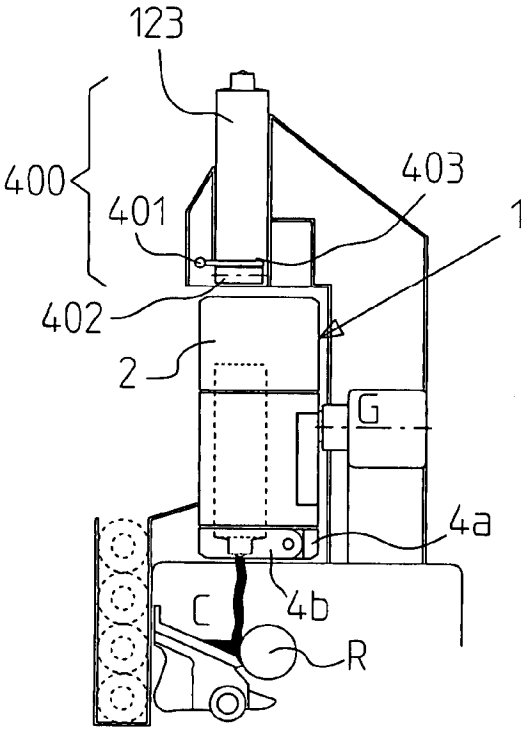
Figure 5C:
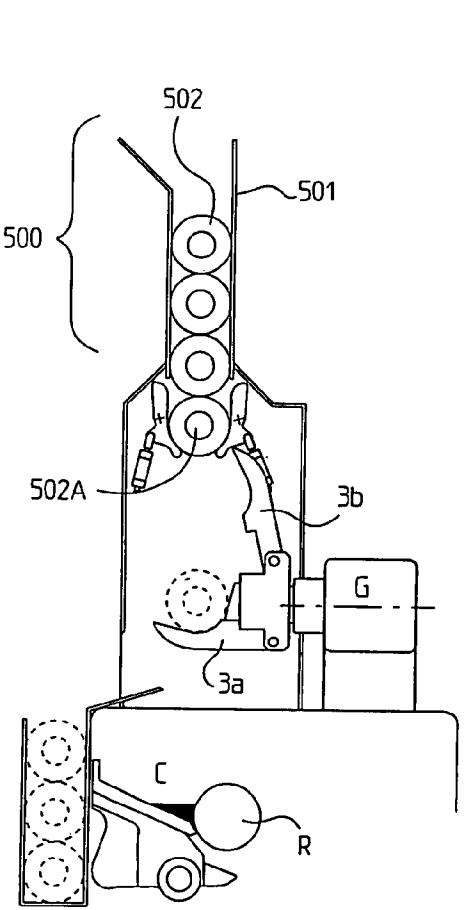
Figure 5B:
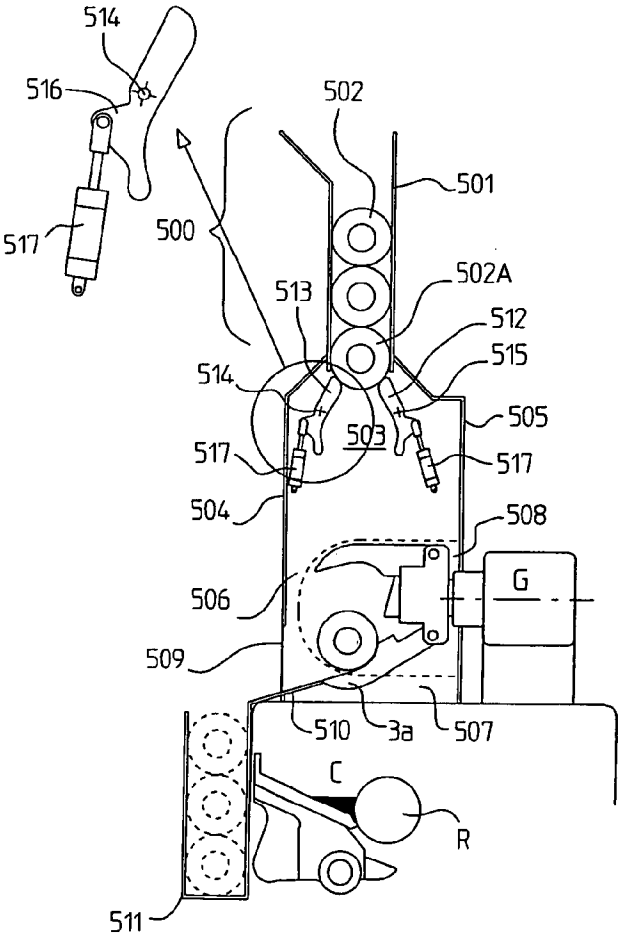
Figure 5A:
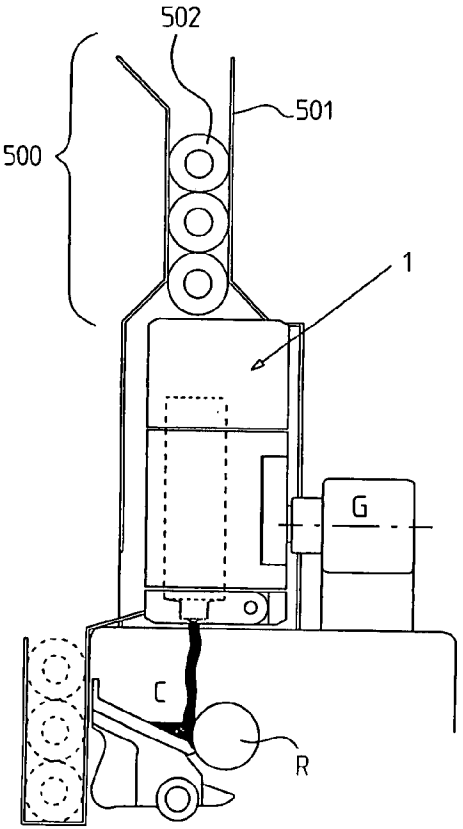
Figure 6C:
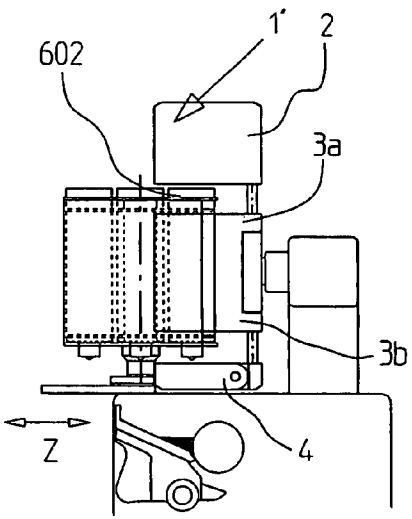
Figure 6B:
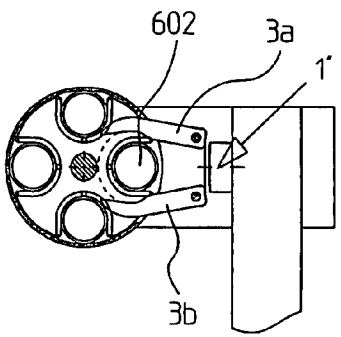
Figure 6B:
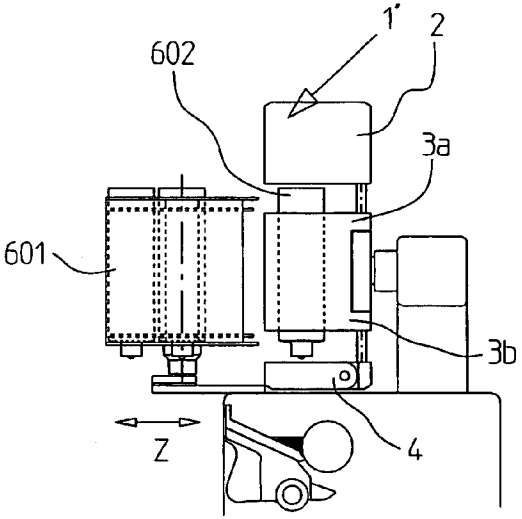

FIGS. 3A, B, C, D are schematic perspective views of four different alternative arrangements for automatically feeding the ink containers to the ink container-holding and dispensing unit and for discharging the empty containers;

FIGS. 4*a, b, c* show schematically three different phases relative to the loading and discharge of the containers by the device of the invention in the variant 3A;

FIGS. 5*a, b, c* show schematically three different phases relative to the loading and discharge of the containers by the device of the invention in the variant 3B;

FIGS. 6*a*, 6*b* and 6*b*1, 6*c* and 6*c*1 show schematically three different phases relative to the loading and discharge of the containers by the device of the invention in the variant 3C, FIGS. 6*b*1 and 6*c*1 being plan views of FIGS. 6*b* and 6*c;*

Figure 7C:
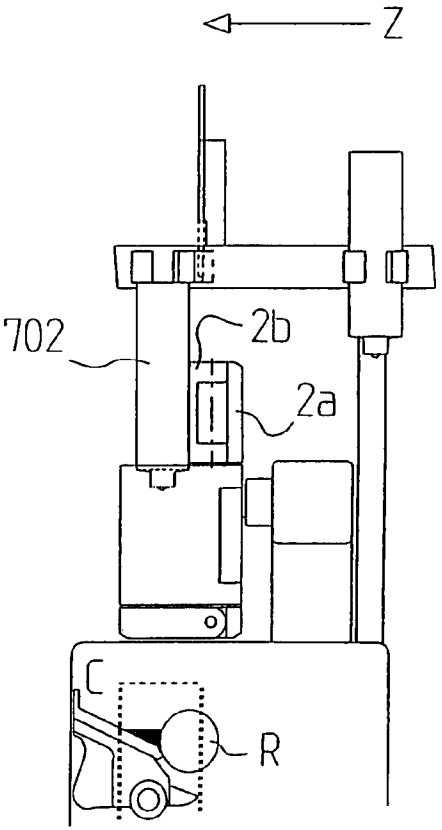
Figure 7B:
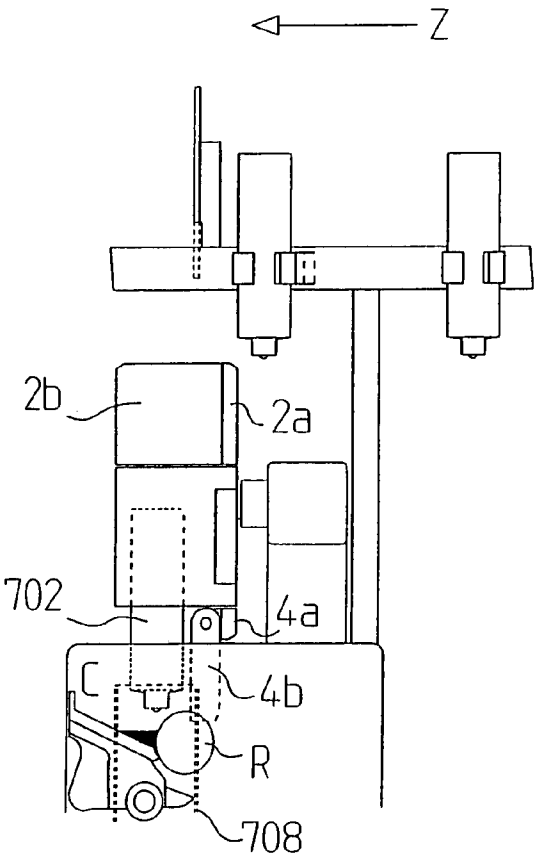
Figure 7A:
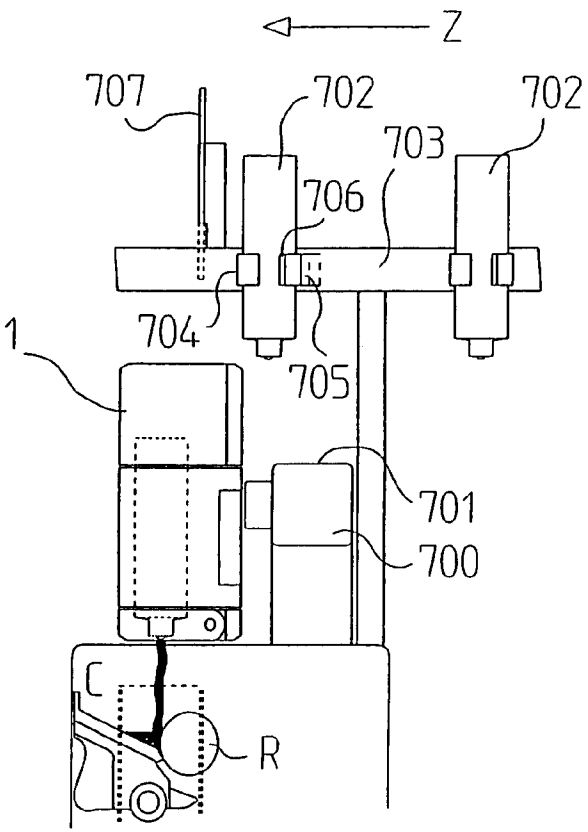

FIGS. 7*a, b, c* show schematically three different phases relative to the loading and discharge of the containers by the device of the invention in the variant 3D.

With reference to the figures, a first version of the device of the invention comprises an ink container-holding and ink dispensing unit indicated by 1" comprising a head 2, two mutually cooperating jaw elements 3*a* and 3*b*, a base 4 and a support part 5.

In the illustrated example the support part comprises two upper parallel columns 6*a*, 6*b* and two lower parallel columns 6*c*, 6*d* connected respectively to the part 2*a* of the head 2 and to the part 4*a* of the base 4 (described hereinafter), and an intermediate connection element 7 having an approximately T-shaped cross-section extending partly between the two jaw elements 3*a*, 3*b*.

The intermediate element 7 (see FIG. 1*a*) presents at its rear a projecting pin 8 rotatably supported in a support member 9 via bearings 10.

On the pin 8, between the bearings 10, there is keyed a gearwheel 11 engaging a rack 12 which is axially guided within said support member 9 and driven by a pneumatic actuator 13 fixed thereto. Consequently the support part 5 can rotate about the geometrical axis G of the pin 8 (arrows F1).

The head 23 comprises two parts 2*a*, 2*b*. The part 2*a* is rigid with the two upper columns 6*a*, 6*b*, which are mounted slidable via conventional bearings or slide supports, not shown, on the intermediate connection element 7, and is driven by two cooperating coaxial pneumatic actuators, partly shown, provided with rods 15*a*, 15*b*, the first 15*a* of which is connected to the part 2*a*, while the second 15*b* is connected to the connection element 7 by a connection plate 15*c*.

The part 2*a* presents at one of its ends a jutting connection plate 16 fixed in proximity to a lateral edge of the part 2*a* and to which is fixed the pin 17 passing in an eccentric position through the part 2*b* which is rotatably supported on said pin 17 via thrust bearings 18. On the side distant from the pin 17 the part 2*b* presents means for rotating it (about the pin 17) such as to bring it into the position shown by dashed lines in FIGS. 1, 1*c* (arrows F2). In this example these means are represented by an appendix 19 projecting from the part 2*b* and to which the rod of a pneumatic actuator 20 is hinged, its cylinder being fixed on one side of the part 2*a*.

Figure 1A:
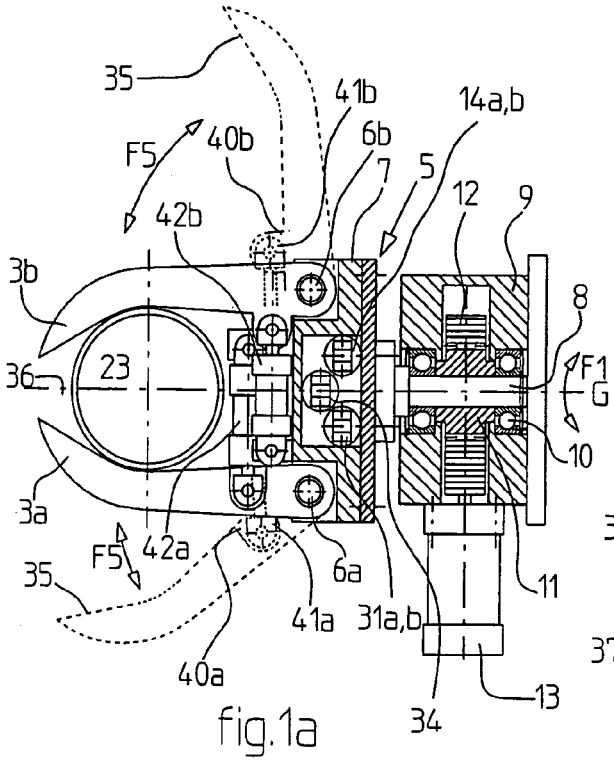
Figure 1C:
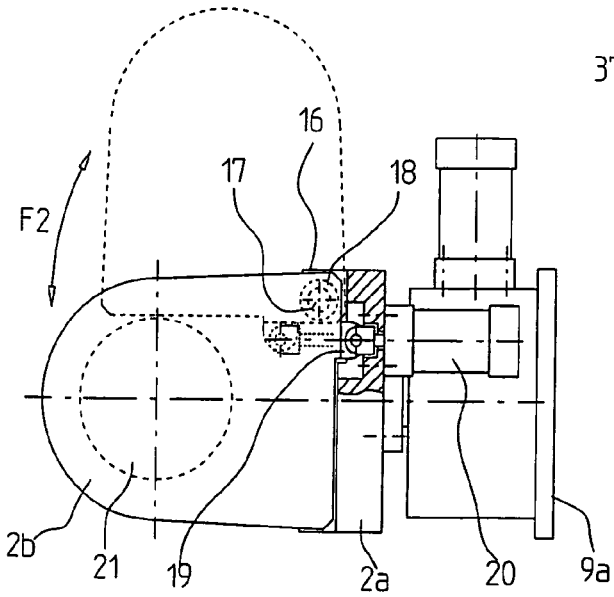

In the part 2*b* a cylindrical chamber 21 is present within which an expulsion means 22 sealedly slides to expel the ink from a container 23 which contains it. In FIG. 1*d* this expulsion means is represented by a telescopic piston comprising two hollow components, of which an upper component 24 is sealedly guided within the cylindrical chamber 21, and the other 25 is intended to press against the container 23 (specifically, in the example, on the movable end 26 of the container 23), the exit or delivery mouth 27 of which faces downwards and is received in a seat 28 in a part 4*b* of the base 4 (FIG. 1), this seat being provided with an outlet hole 29.

The base 4 comprises two parts 4*a*, 4*b* hinged together at 30.

The part 4*a* of the base is rigid with the lower columns 6*c*, 6*d*, which are mounted slidable within the intermediate connection 7, and is driven by a drive arrangement partly shown (in FIG. 1) and identified by the reference numerals 31*a*, 31*b* and 32*a*, 32*b*, it being substantially identical to that indicated by the reference numerals 14*a*, 14*b* and 15*a*, 15*b* relative to the drive of the part 2*a* of the head 2. This means that there are two cooperating coaxial pneumatic actuators 31*a*, 31*b* provided with rods 32*a*, 32*b*, the first 32*a* of which operates on the part 4*a* to move with it the entire base 4 and the columns 6*c*, 6*d* in the direction of the arrows F3, whereas the second 32*b* is connected to the element 7 by the connection plate 32*c*.

Figure 1B:
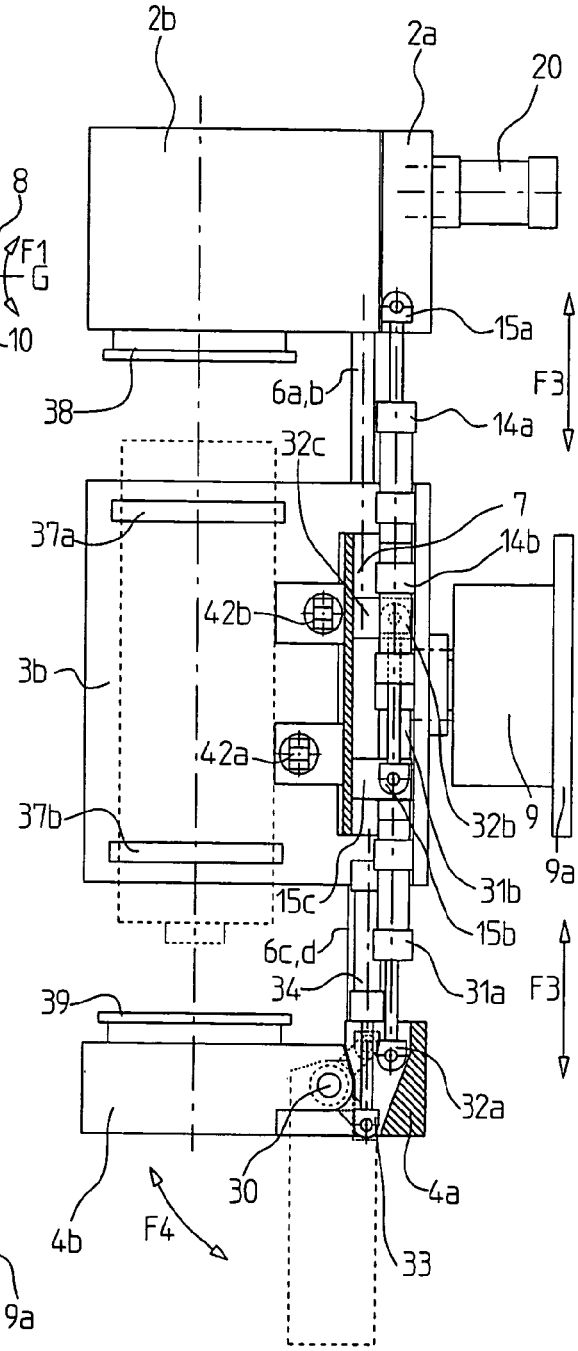
Figure 1D:
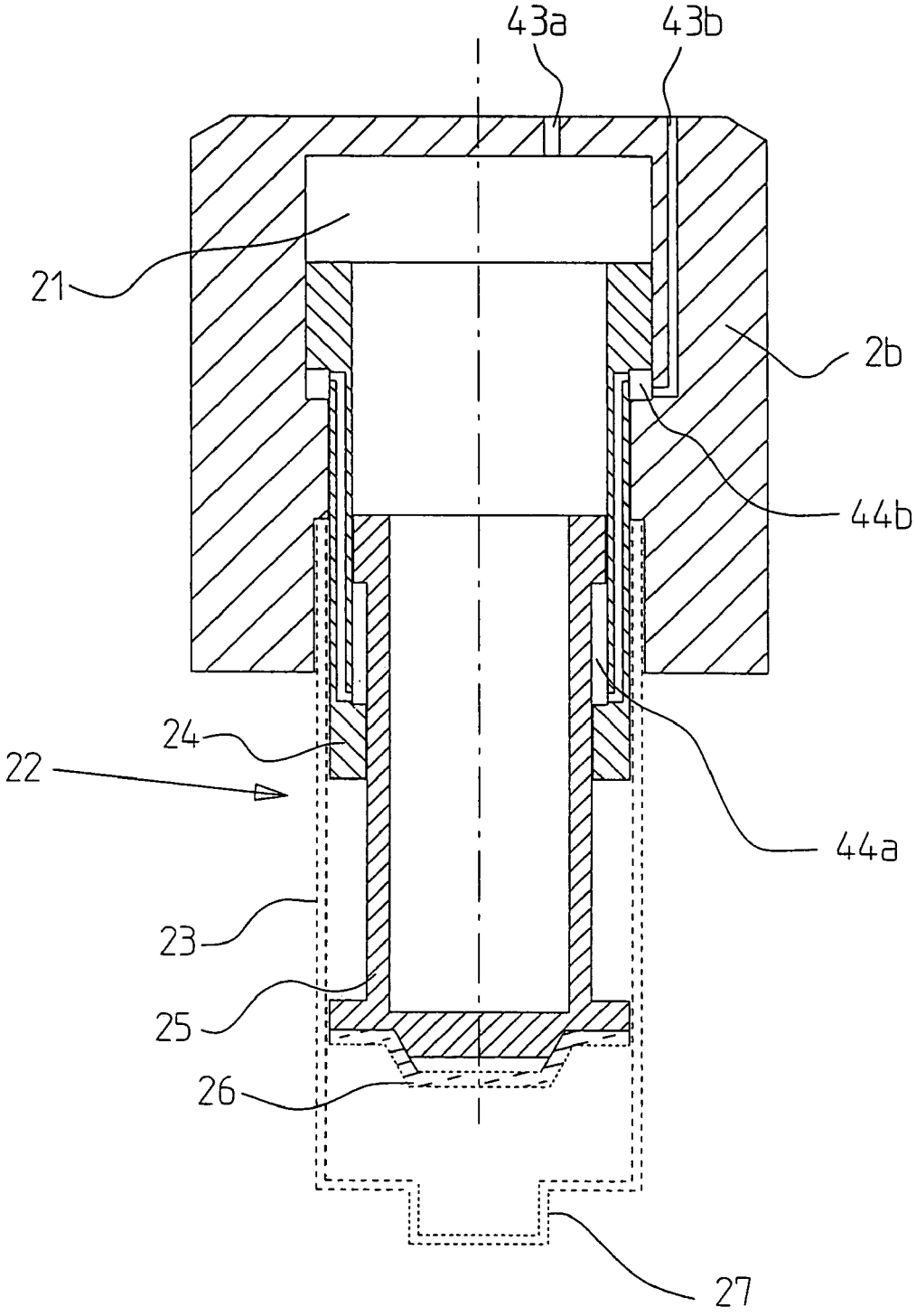

The part 4*b* is rotated (arrows 4) about the axis or pin of the hinge 30 for example by the device shown in FIG. 1*b*, by which a projecting appendix on the part 4*b* is hinged to the rod 33 of a pneumatic actuator 34, the cylinder of which is fixed to the part 4*a* of the base 4.

The jaw elements 3*a*, 3*b* are supported rotatable (arrows F5), but axially immovable, by the upper columns 6*a*, 6*b* and by the lower columns 6*c*, 6*d*. In the position shown in FIG. 1 the two jaw elements are wide apart, but can be closed together at their outer ends to form with their facing profiled (arcuate) faces 35 a compartment 36 (FIG. 1*a*) which encloses and centres the container 23.

In proximity to their upper and lower ends the two jaw elements 3*a*, 3*b* present grooves 37*a*, 37*b* shaped such as to mate, when applied thereto, annular projections 38, 39 on the part 2*b* of the head 2 and on the part 4*b* of the base 4 respectively, to achieve a reliable closure.

Controlled rotation of the jaw elements (arrows F5) is obtainable, for example, by the device shown in FIG. 1*a*. In this figure, in that part close to the intermediate element 7, the jaw elements 3*a*, 3*b* present couplings 40*a*, 40*b* for hinging the rods of respective pneumatic actuator 42*a*, 42*b* supported by the intermediate element 7.

With specific reference to FIG. 1*d*, compressed air is fed to the expulsion means 22 of the head 4 through conduits 43*a*, 43*b*.

Specifically, the conduit 43*a* feeds compressed air into the cylindrical chamber 21 to move the telescopic piston 22 (in the sense of expelling the ink), while the conduit 43*b*, formed both in the part 2*b* of the head 2 and in the wall of the upper component 24 of the telescopic piston 22, feeds compressed air into the cylindrical chambers 44*a*, 44*b* to move it in the opposite direction.

Figures 2A, 2B, 2C, 2D:
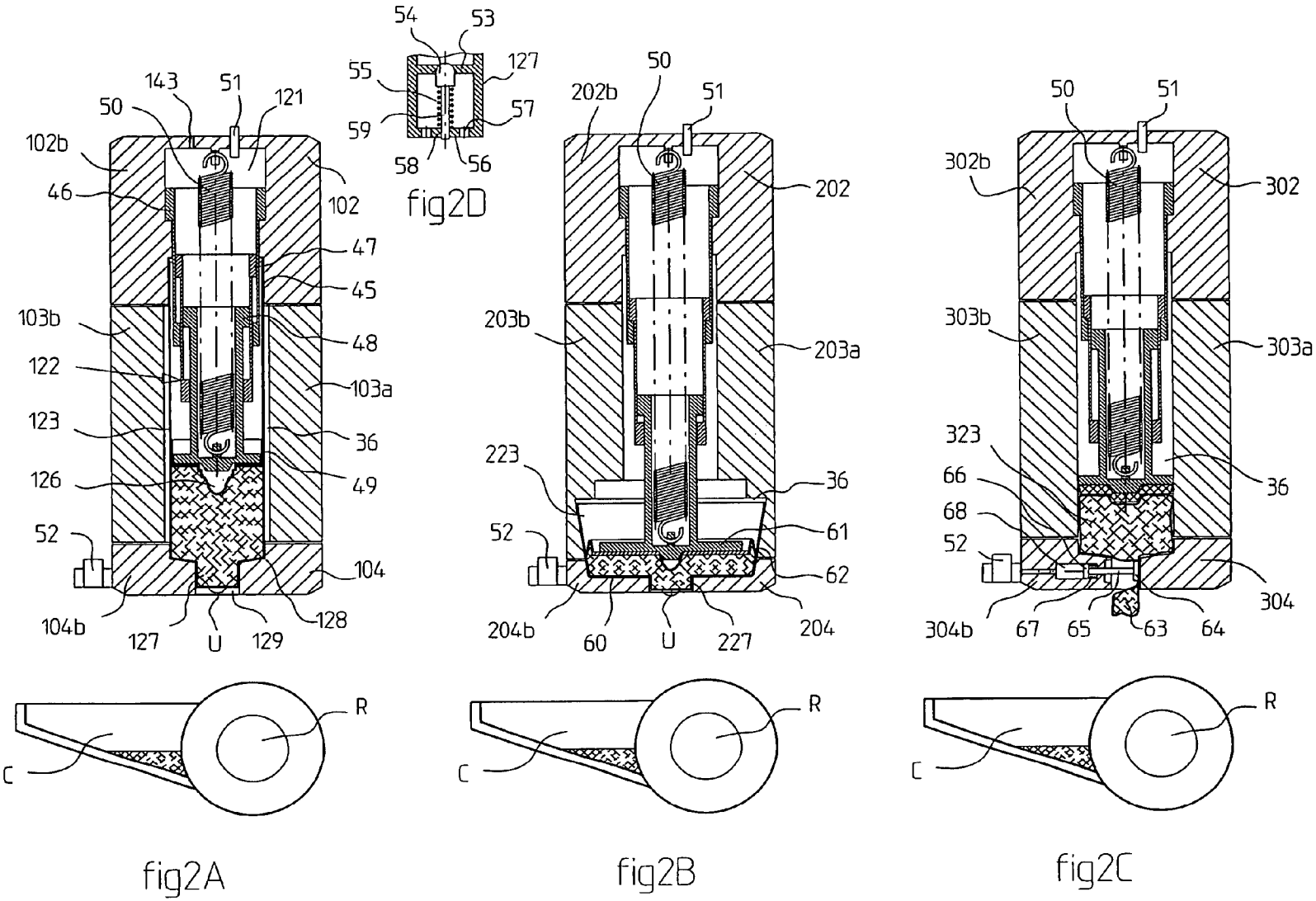
FIG. 2D is a schematic section through a unidirectional ink dispensing valve mounted in a container.

FIGS. 2A, B, C show part of three versions of the container-holding and ink dispensing unit in their operative position.

The versions of these figures differ in that they dispense ink from three different types of container. In these figures, identical or corresponding parts of the device (but not of the container) are indicated by the same reference numerals as previously plus 100, 200 and 300 respectively, whereas different parts do not follow this rule.

In these figures the jaw elements 103*a*, 103*b*; 203*a*, 203*b*; 303*a*, 303*b* are closed to define the compartment 36 for holding the ink container. The container of FIG. 2A is again a cartridge 123 with a movable top 126. The relative lower end, with dispensing nozzle 127, is housed in a corresponding seat 128 in the part 104*b* of the base 104, this seat opening into the outlet hole 129. The top of the container is inserted into a hole 45 in the part 102*b*.

Instead of the expulsion means 22 of FIGS. 1 and 1*d*, the illustrated unit uses a different expulsion means 122 to expel the ink. This expulsion means consists of a telescopic piston with three hollow components 446, 47, 48, one (46) mounted sealedly slidable within the part 102*b* of the head 102 in a cylindrical chamber 121, an intermediate second component (47) mounted sealedly slidable within the component 46, and a tubular third component (48) of closed base mounted sealedly slidable within the intermediate component 47 and provided with a thrust head or disc 49. The cylindrical chamber 121 is connected (at 143) to a compressed air source, not shown, for moving the telescopic piston (in the sense of expelling the ink). A return spring 50 extends into the piston and is fixed at its ends to the top of the cylindrical chamber 121 and to the closed base of the tubular third component 48 respectively.

The part 102*b* of the head 102 comprises a sensor 51 which enters the cylindrical chamber 121, to monitor the extension of the expulsion means and hence indicate the level of ink in the container and warn, with adequate warning, of the empty state to enable the container to be immediately replaced either by the operator, or automatically (as described hereinafter).

A further sensor 52 projects from the part 104*b* of the base 104 to sense the ink level in the underlying conventional ink duct C of the printing machine, from which the ink is withdrawn by a conventional doctor roller R.

In detail, the cartridge 123 is provided at its dispensing nozzle 127 with a unidirectional valve U having flexible or spring-loaded internal components which, under the thrust exerted by the ink subjected to the action of the telescopic piston, opens to enable the ink to be dispensed. A valve of this type is shown in FIG. 2D, in which the dispensing nozzle is indicated by 127. In it there is provided a centrally holed diaphragm 53. The hole is intercepted by a mushroom-shaped valving element 54 on which there acts a compression spring 55 acting against the base 56 of the nozzle. The base is provided with ink exit holes 57 and guides within its central hole or passage 58 the stem 59 of the valving element 54.

FIGS. 2B and 2C show the container-holding and ink dispensing unit suitable for dispensing ink from containers other than the cartridge of FIG. 2A. In FIG. 2B the container is represented by a pot 223 to the base 60 of which there is applied, within the dispensing nozzle 277, a spring-loaded unidirectional valve U similar to that described. In this case the two jaw elements 203*a*, 203*b* are shaped such as to mate, when applied thereto, with portions of the conical side wall of the pot, the lower portion of which (provided with the nozzle 227) is received in the correspondingly shaped part 204*b* of the base 204. The head 202 of the telescopic piston is provided with a pressing disc 61 removable connected to it, for example by screws or snap fittings, and provided with an elastically deformable peripheral gasket 62 which adheres, to substantially seal, against the inner wall of the pot.

The pressing disc in question acts directly on the ink contained in the pot after a usual lid, not shown, has been removed therefrom.

FIG. 2C shows the adaptation of the container-holding and ink dispensing unit to a container consisting of a tubular sachet 323 of flexible material, such as polyethylene, provided with an end appendix 63 closed by transverse bonding and able to open, as a result of the pressure exerted by the telescopic piston pressing on the opposite side of the container. The tubular sachet is confined by the correspondingly shaped jaw elements 303*a*, 303*b*, the end appendix 63 (with part of the outline of the tubular sachet) being housed in a seat in the part 304*b* of the base 304 In the part 304*b* there is provided a controlled means for interceptingly closing the end appendix 63 of the tubular sachet 323 (once opened) to suspend ink dispensing. By way of example, this closure means is shown as a disc 64 carried by the rod 65 of a piston 66 which sealedly slides, against a return spring 67, within a cylindrical chamber 68 present in the part 304*b* of the base 304 and connected to a compressed air source.

Closure takes place when the sensor 52 senses a sufficient degree of filling of the underlying ink duct C.

The container-holding and ink dispensing unit operates in various ways based on the mobility of its various components.

With the jaw elements (3*a*, 3*b*; 103*a*, 103*b*; 203*a*, 203*b*; 303*a*, 303*b*) widened apart, and with the head (2; 102; 202; 302) and/or a head part (2*b*; 102*b*; 202*b*; 302*b*), the base (4; 104; 204; 304) and/or a base part (4*b*; 104*b*; 204*b*; 304*b*) raised or rotated outwards, the operator can remove an empty ink container and replace it with another full container. The base and/or base part, the head and/or head part and the jaw elements are then moved in the reverse order to retain the container and enable the expulsion means of the head to exert on the container the pressure necessary to dispense the ink.

Specifically, the jaw elements (3*a*, 3*b*; 103*a*, 103*b*; 203*a*, 203*b*; 303*a*, 303*b*) are firstly made to widen (arrow F5 in FIG. 1) by the pneumatic actuators 42*a*, 42*b*, in order to be able to then partially withdraw (arrow F3 directed upwards in FIGS. 1, 1*b*) by means of the respective pistons 14*b* and 31*b*, the head (2; 102; 202; 302) and/or (in the opposite direction, but with the same result) the base (4; 104; 204; 304) by disengaging their annular projections 38, 39 from the grooves 37*a*, 37*b* in the jaw elements. At this point said members are made to approach the container, whereas the head and/or head part, and the base and/or base part are raised completely by the respective pistons 14*a* and 31*a*, and/or rotated by the respective pistons 20, 34 to unload an empty ink container.

A full container is loaded in the same manner but in the reverse order: the head and/or head part and the base and/or base part are partially withdrawn from each other and then, after opening the jaw elements, are applied completely to the container. The final rotation of the jaw elements to close them re-inserts the annular projections on the head and base part into the corresponding grooves in the jaw elements.

A further method of removing the container is to rotate the entire unit 1" through a given angle about the horizontal axis (G in FIG. 1) until the longitudinal axis of the device has reached for example 45° or more to the horizontal, then to rotate the part (4*b*; 104*b*; 204*b*; 304*b*) of the base (4; 104; 204; 304) into the position shown by dashed lines in FIG. 1 and open the jaw elements (3*a*, 3*b*; 103*a*, 103*b*; 203*a*, 203*b*; 303*a*, 303*b*) in the previously described manner so that the container rests on one of them, and then to slide it downwards, possibly thrust by the expulsion piston (22, 122, 222, 322).

To load a full container with the device inclined, the container is positioned manually on one of the jaw elements which, by interacting with the part (4*b*; 104*b*; 204*b*; 304*b*) of the base (4; 104; 204; 304), are moved in the reverse order as far as their initial position so that the entire device can be rotated into a vertical position.

Other methods will be apparent hereinafter.

The unit 1" can be mounted stationary, i.e. in a fixed position, by the connection flange 9*a* (FIG. 1) and screw means, on a fixed structure overlying the ink duct C.

The device of the invention also comprises the version in which its unit 1" is supported such that it can move linearly above the ink duct C, as shown schematically in FIG. 3, in which the connection plate 9*a* is connected to a slide 73 mounted slidable on a rectilinear guide 69, for example of dovetail shape, which extends transversely above the ink duct and is supported by and fixed at its ends to lateral shoulders 70*a*, 70*b* of a printing machine 71.

Movement in the two directions along the rectilinear guide 69 is obtained for example by a conventional rod-less pneumatic cylinder 72 as shown, or by a recirculating ball or toothed belt transmission.

In operation, the unit 1" is made to translate from right to left and vice versa along the rectilinear guide 69, i.e. with intermittent reciprocating movement, above the ink duct C then, when its ink level control sensor 52 senses a lack of ink in a region of the ink duct C, it feeds a signal to an electronic control unit which controls the action of the expulsion means 22 (for example the telescopic piston with three components 46, 47, 48) to dispense the ink from the container into that given region of the ink duct. In this manner, the ink is well distributed and fed differentially into the various regions of the ink duct on the basis of the consumption in each of them.

The unit 1" can be advantageously implemented as a component of the device of the invention in the form of variants able to automatically change the ink container, as shown schematically in FIGS. from 3A to 3D, in which it moves reciprocatingly above an ink duct C, for example as described in relation to FIG. 3.

Specifically, in FIG. 3 (figure to which FIGS. 4*a*, 4*b*, 4*c* are related), a channel-shaped store 400 for aligned containers (for example cartridges 123) is provided above the ink duct and the unit 1" and is supported by the shoulders of the printing machine. The containers rest on a movable base, formed for example from a succession of idle rollers 402 inclined towards an end of the store in which there is situated an aperture 403 controlled by a conventional selector mechanism which causes a single container to fall from said aperture at a time, while retaining the other containers. When the sensor 51 (FIGS. 2A, 2B, 2C) senses that the container is substantially free of ink and the unit 1" has reached the position for fall of the full container, the unit moves (FIG. 4*b*) to discharge the empty container into a chute (in the already described manner); then it moves into an inverted vertical position (i.e. with its head facing downwards and base upwards), with the jaw elements 3*a*, 3*b* closed, and the part 4*b* of the base 4 is rotated outwards (position indicated by dashed lines in FIG. 1) to enable the full container to then, and only then, fall into the unit 1" (FIG. 4*c*); the base part returns into its initial horizontal position; the unit 1" rotates through 180° to be repositioned vertically and operates so that the expulsion means present in its head exerts the necessary pressure to dispense ink from the new container (FIG. 4*a*).

The part 4*b* of the base 4 is rotated by opening and closing the jaw elements 3*a*, 3*b* to a given extent and for a given number of times, for their engagement and disengagement (in the already described manner). In the version of FIG. 3B (figure with which the FIGS. 5*a*, 5*b*, 5*c* are related, to which reference is also made here), the container-holding and ink dispensing unit 1" again translates along the ink duct C, but for a distance greater than the width of the ink duct C so that it can be brought into a position corresponding with a store to the side of the ink duct C and indicated by 500. The store in question comprises a vertical channel 501 able to contain a series of full ink containers disposed horizontally, these indicated by 502 (corresponding to the containers 123), and supported by a device which enables one container at a time to fall from the vertical channel, the device being described hereinafter. The channel 501 communicates with an underlying chamber 503 bounded by a front wall 504, rear wall 505, outer side wall 506 and inner side wall 507 (this facing the ink duct C). The inner wall 507 presents an aperture 508 which provides access to the chamber 503 of the unit 1" when it is positioned horizontally (i.e. at 90° to the position of FIG. 3B), to lie below the channel 501.

The front wall 504 lowerly presents for the empty containers a discharge aperture 509 bounded lowerly by an inclined plane 510 by which the empty container is conducted to an underlying lateral collector vessel 511. The device which governs the fall of one container at a time from the vertical channel 501 comprises two pairs of profiled levers 512, 513 (only one pair is visible in FIGS. 5*b* and 5*c*), hinged to the walls 506 and 507 respectively at intermediate points 514, 515. The two levers present a rear projection 516, to each of which there is connected the rod of a double acting pneumatic actuator 517, the purpose of which is to cause the two levers of each pair to assume two positions, one of which is shown in FIG. 5*b* and the other in FIG. 5*c*.

When an empty container (this fact being sensed by the sensor 51 of FIGS. 2A, 2B, 2C) has to be replaced, the unit 1" is made to assume a horizontal position (by rotation about the axis G of FIG. 1) by the device of FIG. 1*a*. When in this position it enters the chamber 503. When the unit 1" has entered the chamber, its translational movement stops, the jaw elements 3*a*, 3*b* are widened apart, and the head 2 (FIG. 1) of the unit 1" is partly withdrawn (arrow F3 directed upwards in FIG. 1) to disengage it from the jaw elements, while the base 4 is moved (partly withdrawn) in the opposite direction but with the same result. At this point the jaw elements are made to approach each other and the head and base are withdrawn completely, and then, and only then, is the jaw 3*a* (FIG. 1) again rotated outwards (arrow 5B of FIG. 1) through an angle such (FIG. 5*b*) that the empty container falls by gravity onto the inclined surface 510 to reach the collector vessel 511. The jaw 3*a* is then moved into its initial position (FIG. 5*c*), while the jaw 3*b* rotates outwards to reach the position of FIG. 5*c*, outside the path through which the overlying full container 502A falls. At this point the levers 512, 513 are rotated from the position of FIG. 5*c* to the position of FIG. 5*b* so that the full container 502A falls onto the jaw element 3*a* (FIG. 5*c*), while the remaining containers present in the channel are retained by the upper ends of the levers 512, 513. The levers then return to the position of FIG. 5*c* in which they retain the next full container and the overlying stack of containers.

The jaw 3*b* rotates into its closed position to close the fallen container between it and the other jaw 3*a*; the base 4, simultaneously with the head 2, partly approaches and then, after the jaw elements have been opened, is completely applied to the container; the unit 1" is made to leave the chamber 503; having left, it is made to assume a vertical position and can then translate along the ink duct C to dispense ink.

Figure 6A:
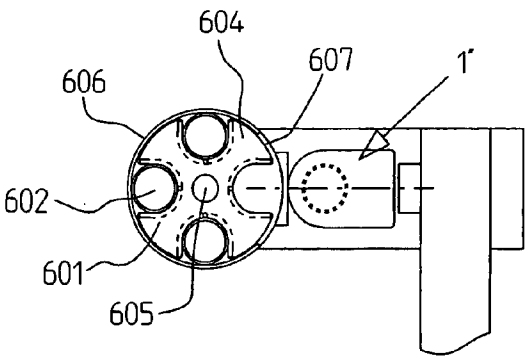
Figure 6A:
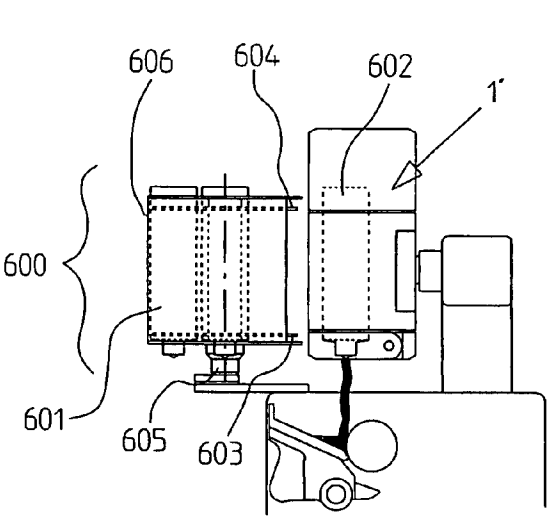

In the version of FIG. 3C (figure with which the FIGS. 6*a*, 6*b*, 6*c* are related, to which reference is also made here), the container-holding and ink dispensing unit 1" again translates along the ink duct C, but for a distance greater than the width of the ink duct C so that it can be brought into a position corresponding with a drum-shaped store to the side of the ink duct C and indicated by 600. The store in question comprises a circular channel 601 able to contain a series of full ink containers disposed vertically, these being indicated by 502 and corresponding to the containers 123, they being supported spaced apart and each retained between pairs of elastic fork elements 603, 604, these pairs being connected to a stepwise-rotatable central pin 605 and projecting radially from it.

The outer wall 606 of the circular channel 601 presents an aperture 607 which enables the unit 1" to be inserted into the store for loading and removing the containers.

In this respect, the store can be driven linearly along a geometrical axis perpendicular to the support structure for the unit 1" (arrow Z) by an actuator and rectilinear guides (not shown).

When the sensor 51 (FIGS. 2A, 2B, 2C) senses that the container is substantially without ink, the unit 1" is made to translate to a position in front of the aperture 607 of the store, in horizontal alignment with, and along the central axis of, a pair of elastic force elements which do not carry any container. With the head 2 and base 4 (FIGS. 6*b*, 6*b*1) of the unit 1" mutually withdrawn (arrows F3 in FIG. 1), the store 600 is made to approach the unit 1" so that the elastic force elements 603, 604 interfere with the empty container and flex to adhere to said container. At this point the jaw elements 3*a*, 3*b* of the unit 1" are opened (arrow F5, FIG. 1) and the store 600 is withdrawn from the unit 1" as far as its initial position (FIG. 6*a*); the central pin 605 of the store, together with the elastic force elements connected to it, is rotated through an angle such that a full container 602 becomes located at the aperture 607 in the outer wall 606. The store 600 then returns into proximity with the unit 1" (FIGS. 6*c*, 6*c*1) and the jaw elements 3*a*, 3*b* of the unit 1" rotate to close, so retaining the container between them and withdrawing it from the store, which withdraws. With the head 2 and the base 4 applied to the container (FIG. 6*a*), the unit 1" can translate along the ink duct C to dispense ink. The head 2 and base 4 are moved (arrows F3 in FIG. 1) by opening and closing the jaw elements 3*a*, 3*b* to a given extent and for a given number of times, for their engagement and disengagement (in the already described manner).

The variant of FIG. 3D (to be read in conjunction with FIGS. 7*a*, 7*b*, 7*c*) again comprises the unit 1" translatable along the ink duct. The unit is able to translate beyond the ink duct as can be seen by the extension 700 of the crosspiece 701, along which the unit translates. When there is little or no ink in the container present in the unit 1", this latter moves into the extension 700 to below and in vertical alignment with a full container 702.

The fill containers 702 are removably supported spaced apart on an endless conveyor 703 advancing in the direction of the arrow Z. The containers are removably retained between two half-jaw elements 704, 705 rigid with the conveyor 703 and projecting laterally from them. One of the half-jaw elements presents a lateral fin or extension 706 arranged to interfere with a stationary member 707 so as to flex, in the opposite direction to the arrow Z, to release the container which can then fall into the underlying unit 1" which, as can be seen from FIG. 7*c*, is arranged to accept it following rotation of the unit head 2 (part 2*b*) about the axis of the pin 17 (arrows F2 in FIG. 1), into the position shown by dashed lines in FIG. 1. These members then return to their initial position, the unit then being able to translate along the ink duct C.

The aforegoing refers to the loading of a full container into the unit 1", however this must be preceded by removing the empty container from the unit 1". Removal takes place when the unit lies in the extension, in the position for loading a full container. In this position the unit 1" lies above a discharge conduit 708 (FIGS. 3D and 7*b*) into which the empty container 702' falls by rotating the base (4, 4*b*—FIG. 1) of the unit 1" into the position shown by dashed lines in FIG. 1. The parts 2*b* of the head 2 and 4*b* of the base 4 are rotated by opening and closing the jaw elements 3*a*, 3*b* to a given extent and for a given number of times, for their engagement and disengagement (in the already described manner).

The invention claimed is:

1. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein the operating head and the base of the holding and dispensing unit are movable linearly relative to each other in a given direction.

2. A device as claimed in claim 1, wherein the intermediate component comprises two cooperating jaw elements movable relative to each other.

3. A device as claimed in claim 1, wherein the holding and dispensing unit can rotate about a first geometrical axis perpendicular to said given direction.

4. A device as claimed in claim 3, wherein the base comprises a part able to rotate about a second geometrical axis perpendicular both to the given direction and to said first geometrical axis.

5. A device as claimed in claim 1, wherein the two cooperating jaw elements can rotate about axes which are parallel to each other and extend in the given direction.

6. A device as claimed in claim 1, wherein the operating head can be moved in the given direction and/or be swivelled about a third axis extending in the same direction.

7. A device as claimed in claim 1, wherein the holding and dispensing unit comprises a further component which rotatably supports the two jaw elements about at least one axis extending in the given direction.

8. A device as claimed in claim 1, wherein the pressing means provided in the operating head are represented by a piston/cylinder unit.

9. A device as claimed in claim 8, wherein the piston is a telescopic piston.

10. A device as claimed in claim 1, wherein the holding and dispensing unit can be driven with reciprocating movement above the ink duct.

11. A device as claimed in claim 10, wherein the reciprocating movement of the holding and dispensing unit above the ink duct takes place along rectilinear guide means supported by a stationary bridge structure straddling the ink duct, said stationary structure presenting operating means for driving said unit with said reciprocating movement.

12. A device as claimed in claim 1, wherein the holding and dispensing unit comprises sensors for determining the quantity of ink in the container and in the ink duct respectively.

13. A device as claimed in claim 1, wherein means are provided for automatically feeding one full container at a time into the holding and dispensing unit and for discharging the empty container therefrom.

14. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein means are provided for automatically feeding one full container at a time into the holding and dispensing unit and for discharging the empty container therefrom, and wherein the means for feeding one full container at a time into the holding and dispensing unit and for discharging the empty container comprise: a store for containing a given number of containers and selector means for withdrawing one container at a time from said store.

15. A device as claimed in claim 14, wherein the store is channel-shaped to contain aligned containers, said store being disposed above the ink duct and the holding and dispensing unit, said store having a movable base inclined towards one end of said store where there is present a passage controlled by a selector mechanism which causes one container at a time to fall from said aperture while retaining the other containers.

16. A device as claimed in claim 14, wherein the store comprises a vertical channel arranged to contain the ink containers disposed horizontally and supported by a selector device which enables one container at a time to leave said channel by falling, the vertical channel communicating with an underlying chamber having an aperture for the entry thereinto of the horizontally positioned holding and dispensing unit, and an outlet for the empty container.

17. A device as claimed in claim 16, wherein the selector device comprises two pairs of profiled levers driven by actuators in such a manner as to assume two different positions, one for arranging a container and the other for releasing said container and for retaining the overlying containers.

18. A device as claimed in claim 14, wherein the store is a revolving drum which is driven from and towards the holding and dispensing unit positioned in front of said unit to, withdraw the empty container from said unit and to enable withdrawing a full container.

19. A device as claimed in claim 14, wherein the store is represented by an endless conveyor which by retention means removably retains said containers, which are released to fall into the holding and dispensing unit when this reaches an underlying position, where said retention means interfere with a stationary release member.

20. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein the intermediate component comprises two cooperating jaw elements movable relative to each other, and wherein the two jaw elements are provided with seats shaped in such a manner as to mate, when applied thereto, with projections present on the operating head and on the base to provide reliable closure of the holding and dispensing unit.

21. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein the holding and dispensing unit can rotate about a first geometrical axis perpendicular to said given direction.

22. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein the operating head can be moved in the given direction and/or be swivelled about a third axis extending in the same direction.

23. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein a store is provided for automatically feeding one full container at a time into the holding and dispensing unit and for discharging the empty container therefrom, and the store is a revolving drum which is driven from and towards the holding and dispensing unit positioned in front of said unit to, withdraw the empty container from said unit and to enable withdrawing a full container.

24. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein the pressing means provided in the operating head are represented by a piston/cylinder unit, and wherein the piston is a telescopic piston.

25. A device for feeding ink prepackaged in containers to an ink duct of printing machines, characterised by comprising a unit for holding the container and for dispensing the ink contained therein, said unit comprising a base provided with at least one through aperture, an intermediate component and an operating head, in which the base, the intermediate component and optionally the operating head define, when in an operative position, a compartment for receiving the container, and in which the operating head comprises pressing means operated by pressurized fluid to exert a pressure on the container ink to dispense the ink, wherein means are provided for automatically feeding one full container at a time into the holding and dispensing unit and for discharging the empty container therefrom.

* * * * *